US011686245B2

(12) United States Patent
Huddleston

(10) Patent No.: US 11,686,245 B2
(45) Date of Patent: Jun. 27, 2023

(54) QUADRUPLE ACTING SCOTCH YOKE ENGINE

(71) Applicant: Sky Moon Huddleston, Bourbon, MO (US)

(72) Inventor: Sky Moon Huddleston, Bourbon, MO (US)

( * ) Notice: Subject to any disclaimer, the term of this patent is extended or adjusted under 35 U.S.C. 154(b) by 0 days.

(21) Appl. No.: 17/368,671

(22) Filed: Jul. 6, 2021

(65) Prior Publication Data

US 2022/0003158 A1 Jan. 6, 2022

Related U.S. Application Data

(60) Provisional application No. 63/048,290, filed on Jul. 6, 2020.

(51) Int. Cl.
*F02B 75/00* (2006.01)
*F02B 75/02* (2006.01)

(52) U.S. Cl.
CPC ..... *F02B 75/002* (2013.01); *F02B 75/02* (2013.01); *F02B 2075/025* (2013.01); *F02B 2075/027* (2013.01)

(58) Field of Classification Search
CPC .. F02B 75/002; F02B 75/02; F02B 2075/025; F02B 2075/027
See application file for complete search history.

(56) References Cited

U.S. PATENT DOCUMENTS 1,466,432 A * 8/1923 Gerleman ..... F02B 77/02 92/155
2,534,406 A * 12/1950 Bramberry, Jr. ..... F02B 77/02 384/42
3,906,923 A * 9/1975 Harker ..... F02F 3/10 92/219
4,559,838 A * 12/1985 Neuenschwander ... F01B 9/023 403/361

(Continued)

FOREIGN PATENT DOCUMENTS

WO WO-8907704 A1 * 8/1989 ..... F02B 75/28
WO WO9849434 * 11/1998

*Primary Examiner* — Hung Q Nguyen
(74) *Attorney, Agent, or Firm* — Michael L. Greenberg, Esq.; Greenberg & Lieberman, LLC

(57) ABSTRACT

The present invention relates to a two strokes per cycle Scotch Yoke engine that completes four power strokes per revolution per pair of pistons/cylinders by using both sides of each piston as a combustion chamber. This doubles the power to weight ratio over previous scotch yoke engines and quadruples the power to weight ratio over conventional 4 stroke cycle engines. The present invention is capable of operating in and withstanding the forces of either deflagration (subsonic) and pulse detonation (supersonic) cycles, and is capable of homogeneous charge compression ignition. The present invention can also be an internal/external combustion gas/steam hybrid. The present invention can operate under constant volume or constant pressure cycles as well as most thermal cycles of operation (EG the Otto and Diesel cycle). The present invention works best when using (Continued)

a modified Humphrey cycle to achieve homogeneous charge compression ignition pulse detonation engine using constant volume combustion.

12 Claims, 4 Drawing Sheets

(56) References Cited

U.S. PATENT DOCUMENTS

| | | | | |
|---|---|---|---|---|
| 5,092,185 | A * | 3/1992 | Zornes | F16C 19/40<br>74/44 |
| 5,307,732 | A * | 5/1994 | Berlinger | F02F 3/0069<br>92/219 |
| 8,640,450 | B2 * | 2/2014 | Rafalski, Jr. | F04B 9/02<br>60/370 |
| 2009/0013681 | A1 * | 1/2009 | Courtright | F02B 75/24<br>60/327 |
| 2014/0318518 | A1 * | 10/2014 | Jeswine | F01B 9/023<br>123/73 R |
| 2021/0003121 | A1 * | 1/2021 | Gamble | F04B 35/002 |

* cited by examiner

QUADRUPLE ACTING SCOTCH YOKE ENGINE

CONTINUITY

This application is a non-provisional patent application of provisional patent application No. 63/048,290, filed on Jul. 6, 2020, and priority is claimed thereto.

BACKGROUND OF INVENTION

Most conventional engines of the 2 stroke per cycle variety typically rely on the underside of the piston, which in such designs are open to the crankcase, to act as a supercharger to force exhaust gases out of and fresh fuel/air mixture into the combustion chamber when the piston reaches the bottom most portion of its stroke and cycle. Some 2 stroke per cycle engines, especially larger industrial engines, one such example being the Detroit Diesel Series 71, instead rely on a supercharger or turbocharger bolted to the engine to provide this scavenging force rather than pressurizing the crankcase. However, these engines fail to exploit a benefit of relying on an external supercharger and/or turbocharger because they still only use one side of the piston to convert chemical energy in the form of combustible fuels into mechanical energy. The reason why they are unable to do so is because conventional connecting rod engines can not isolate the bottom of piston from the crankcase oil. Furthermore, 2 stroke cycle engines despite their higher power to weigh ratio's and greater overall efficiency have recently fallen out of favor due to recent NOX emissions standards.

In response to this, industry as a whole has, with few minor exceptions, not pursued innovating new mechanisms to solve these challenges, instead choosing to rely almost exclusively on computer controls, electronics, catalytic converters, and various other accoutrements to reduce emissions and attempt to increase power output of conventional 4 strokes per cycle engines and has done so with limited success from an engineering perspective. However this approach, though traditionally considered to be financially safe by accountants, has resulted in engines that are of much greater complexity, cost, are considerably more difficult to maintain, and are less adaptable for a wider scope of uses. As a result, conventional engine of the current era are highly specialized machines, and the performance gains in efficiency, power output, power to weight and displacement ratio have been relatively marginal at best. To this day even the most efficient conventional piston engines have a mere 50% thermal efficiency, and these high (by conventional standards) efficiency engines have abysmal power to weight ratio's. It is for these reasons that a new generation of engines are needed. Engines boasting higher power to weight ratio's, higher efficiency, less moving parts, less internal friction, and simpler more robust and easier to maintain designs will be necessary in the 21st century and beyond. Previous attempts at commercializing scotch-yoke type engines have failed for a plethora of reasons. One of those reasons is that though they have higher power to weight ratio's and efficiency than conventional engines, the performance increase is not sufficient to justify switching to a new designs.

SUMMARY OF PRESENT INVENTION

The present invention is a high efficiency and extraordinarily high power to weight ratio quadruple acting scotch yoke engine. In this engine, each piston/cylinder complete 2 full cycles and power strokes per revolution of the crankshaft. Because this engine is a scotch yoke engine, each pair of pistons complete 4 full cycles and power strokes per revolution. In this way, the pistons and by extension the engine can be described as a "monostroke" cycle engine because the piston is completing a full power stroke in both directions of movement at any time. In this way the piston both pushes and pulls on the connecting rod. When the top side of the piston reaches top dead center, as in a normal engine, it combusts the fuel and air mixture and pushes downward on the connecting rod through the downstroke. However, upon reaching bottom dead center, the other side of the same piston is compressing a new charge of fuel and air mixture, which then subsequently ignites and pushes on the piston. When the bottom side of the piston is being pushed by the expanding explosion the piston pulls on the connecting rod. The exact same process is synchronously occurring in tandem on the other side of the scotch yoke. The scotch yoke is ergo being used to simultaneously transduce linear forces of both pushing and pulling into rotational energy at any given time. Though each individual piston is double acting, for optimal efficiency and power output a scotch yoke engine necessitates a piston on both sides of the scotch yoke. This means that the engine can only have any even number of pistons. Because an even number is necessary to achieve optimal performance, every yoke assembly has 2 pistons. With 2 pistons for every scotch yoke assembly this means that every scotch yoke assembly achieves 4 power strokes and 4 full cycles per revolution of the crankshaft. Thus the engine is called a quadruple acting engine as every yoke journal of the crankshaft is transducing 4 power strokes and 4 full cycles per revolution.

DETAILED DESCRIPTION OF THE VARIOUS EMBODIMENTS

Figure 1:
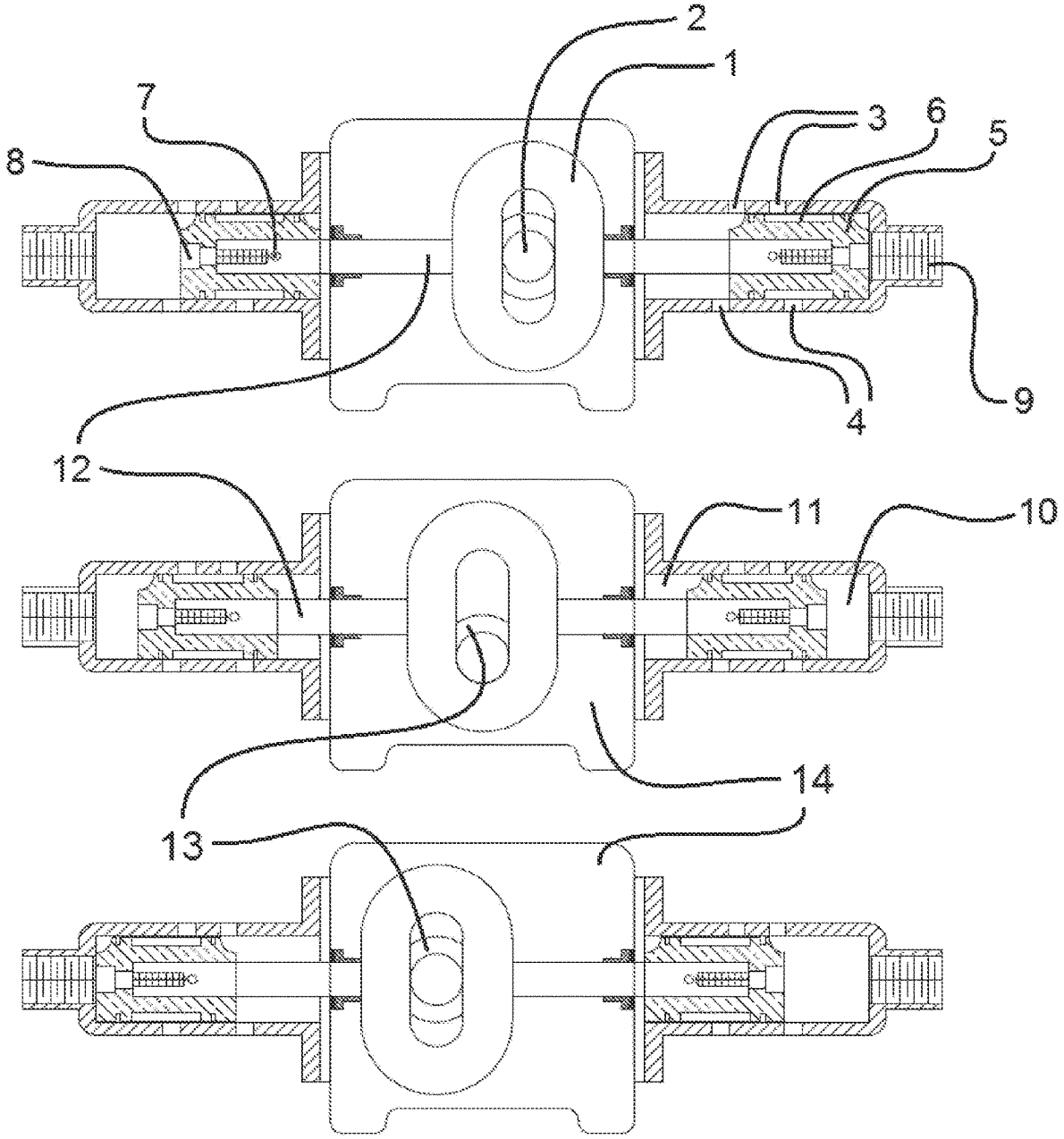
FIG. 1 exhibits three cross sectional views of the side of the present invention as the crankshaft and piston/yoke/connecting rod assembly conducts one half of one crankshaft revolution by moving 180 degree's of rotation and the piston/yoke/connecting rod assembly move from top dead center to bottom dead center.
Figure 2:
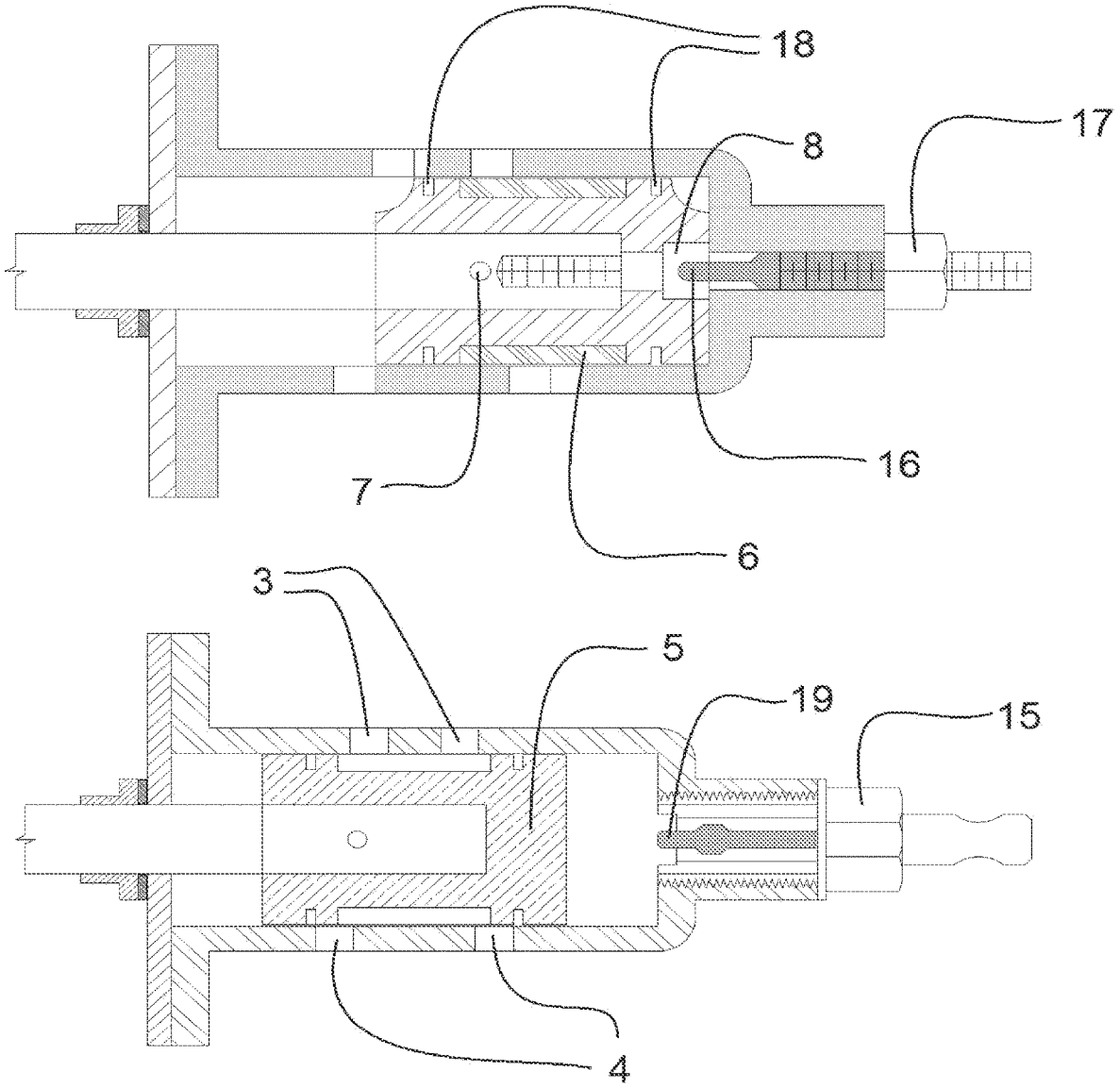
FIG. 2 exhibits a closeup cross sectional view up of the side of the cylinder and piston to more accurately illustrate its various parts.
Figure 3:
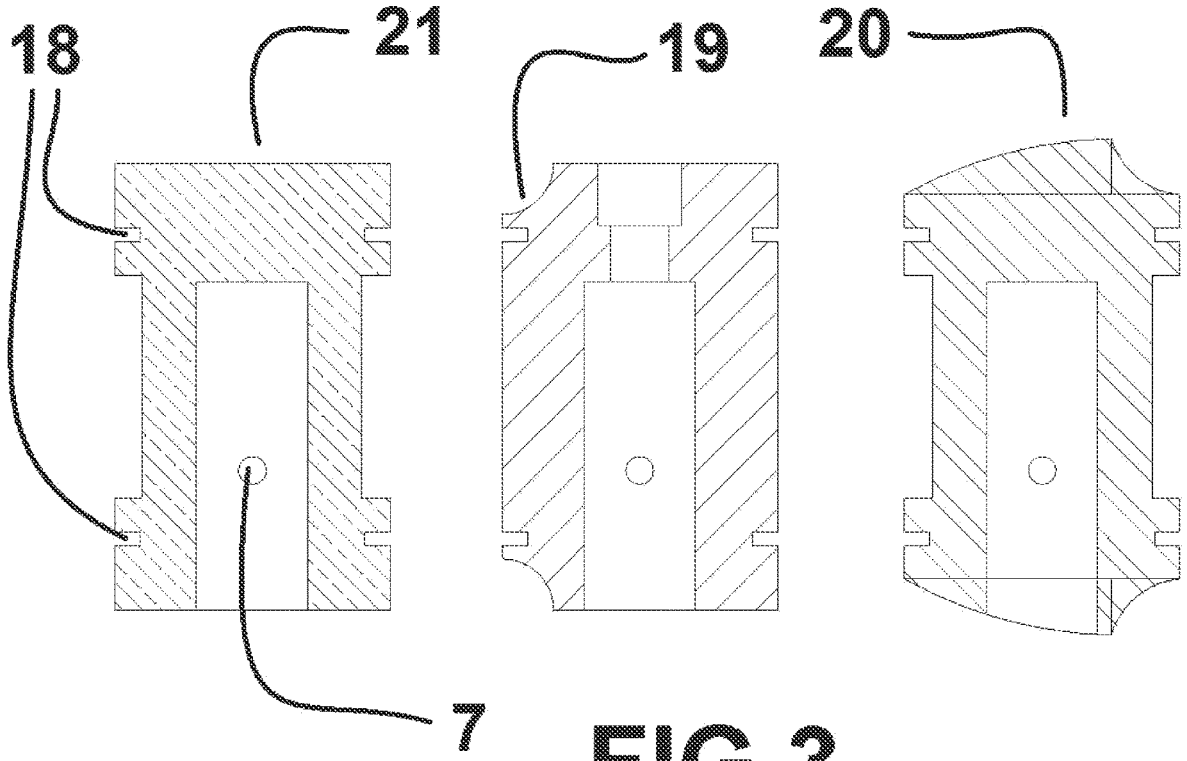
FIG. 3 exhibits some (but not all) examples of the different types of piston profiles can be used in the present invention.
Figure 4:
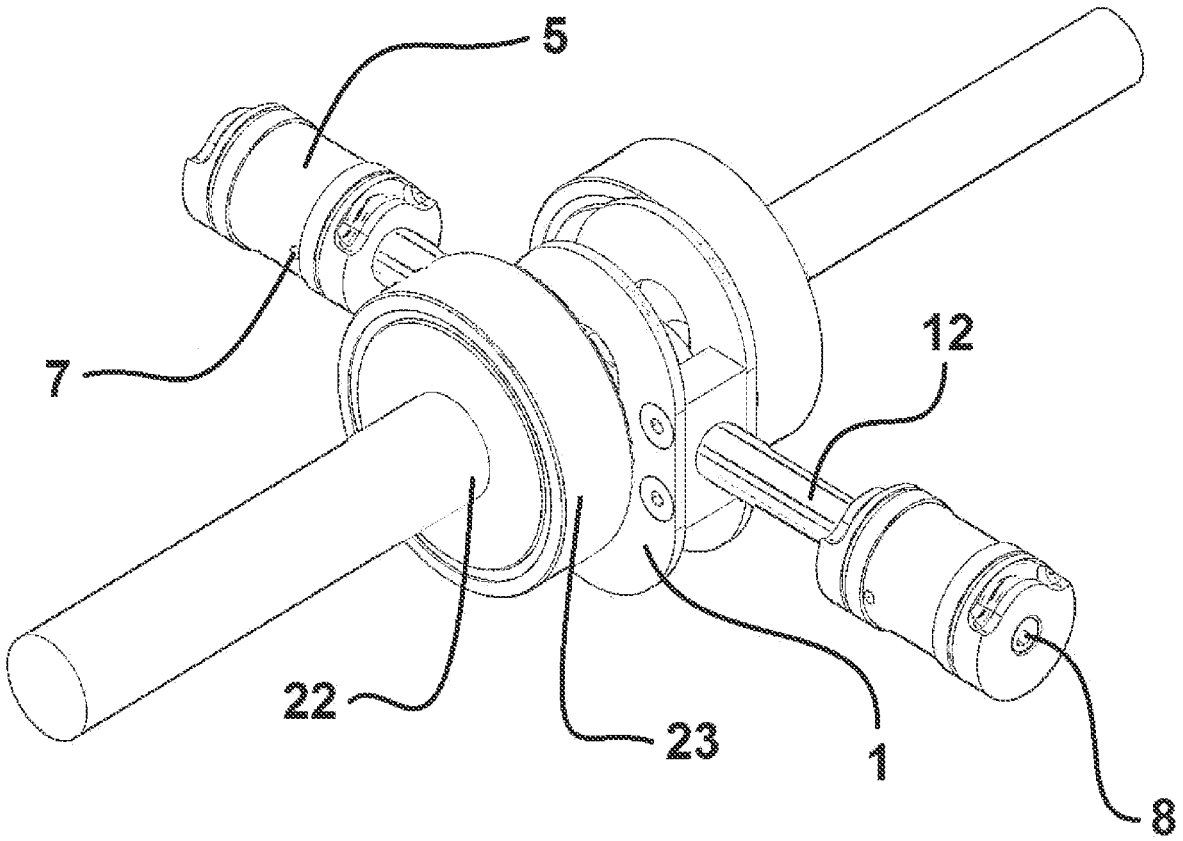
FIG. 4 exhibits a scotch yoke connected to a roller disc webbed tunnel type crankshaft.

The present invention is a scotch yoke (1) type engine that uses pairs of double acting pistons (5) thus making the yoke (1) quadruple acting. Each cylinder of the present invention is equipped with an inner combustion chamber (11) an outer combustion chamber (10), a cylindrical connecting rod (12), an optional threaded hole(s) (9) to receive spark plugs, glow plugs, direct injectors, sensors, etc. can be integrated into the combustion chamber, intake ports (3), exhaust ports (4), and a skirtless piston (5). A yoke journal (2) connected to the crankshaft converts linear motion from the reciprocating components into rotational energy. The piston (5) can be attached to the connecting rod (12) using a wrist pin (7) and/or a screw (8). When using a screw (8) in addition to or instead of a wrist pin (7) rocking of the piston (5) in the cylinder along the axis of the wrist pin (7) is eliminated.

Because of the quadruple acting nature of the engine, a special piston (5) is recommended to be used. A conventional piston with skirts and exposed wristpins would not develop a high enough compression ratio to efficiently burn the fuel and air mixture on the inner combustion chambers closest to the crankshaft (22). Thus a cylindrical slug is the recommended piston (5) shape to be used in a quadruple acting scotch yoke engine. Such a piston can have a flat top (21) profile when using loop flow scavenging such as when using Schnuerle porting. Additionally, a deflector head (20) or QUB (19) head profile can be used when using cross flow port scavenging. Optionally, a combination or hybrid of porting can be used. For example, Schnurle type porting for a loop flow can be used on the outer combustion chambers (10) and cross flow type porting can be used on the inner combustion chamber (11), or vice-versa. However, such a piston (5) will not have a skirt as both sides of the piston (5) will be a piston head.

Because the piston (5) is completely isolated from crankcase oil, external lubrication will need to be provided. This can come in many forms including but not limited to an oil cup, oil reservoir, a controlled oil delivery system of the mechanical or electronic variety. In the case of low speed quadruple acting scotch yoke engines for stationary power, grease fittings such as alemite fittings, grease cups, and/or button head fittings, among others, can be used to deliver grease and/or oil to the pistons. As an addition to or a replacement of lubrication delivery, a bushing (6) can be sandwiched between the two top rings (18) of the piston. This bushing (6) will serve to replace the function of the piston skirt normally found in a conventional engine. It will serve to conduct piston heat into the cylinder walls and keep the piston (5) concentrically aligned in the bore of the cylinder. Because of the dual sided nature of the piston (5), this eliminates the second ring and oil scraper ring from the ring pack. This serves to further reduce the total number of parts in the engine and reduces ringpack friction. Furthermore, the bushing (6) can be used to retain the wrist pin (7) instead of a conventional snap ring or circlip.

To increase the starting reliability of the quadruple acting scotch yoke engine in arctic or otherwise extreme environments, glow plugs (17) and/or spark plugs (15) can be screwed into an optional threaded hole (9) and/or a multitude of threaded holes. Though any type of spark plug (15) or glow plug (17) may be used, to further increase compression ratio when using a glow plug (17) the engine can be designed to seat the glow plug (17) deep enough that the hot bulb (16) of the glow plug (17) seats inside the recessed hex head of the cap screw (8) that can be used to secure the piston (5) to the connecting rod (12). In cases where a wrist pin (7) is exclusively used to secure the piston (5) to the connecting rod (12) without a screw (8), a recessed hole bored into the face of the piston (5) can be used. When using a spark plug (15), a ground electrode can be used but is not necessary. As with the hot bulb (16) of a glow plug (17), the engine can be manufactured in such a way that the center electrode (19) of a spark plug (15) can protrude into either a recessed hole in the piston (5) face or the recessed hex of the cap screw (8) that can be used to secure the piston (5) to the connecting rod (12).

In arrangements where a cap screw (8) or bored hole in the piston (5) face is not being used, the center electrode (19) can be installed flush with the top of the outer combustion chamber (10) and/or inner combustion chamber (11). In either case, such a method of installing a spark plug (15) without a side/ground electrode built into the spark plug (15) presents a unique opportunity to control ignition timing by altering how much voltage is fed to the spark plugs (15) rather than controlling the spark timing by magneto, breaker points, or computer. This is possible because we can exploit Paschen's law to consistently perform incredibly accurate constant and/or variable spark timing without the need for EMP vulnerable computer control systems, complex breaker points, or magneto ignition systems. Instead, a robust solid state voltage boosting circuit can be used to provide the spark plugs the proper voltage for timing. We can use Paschen's law to control spark timing because as the piston compresses the fresh charge of fuel/air mixture it also approaches the center electrode (19) of the spark plug (15) and as it approaches the center electrode (19) of the spark plug (15) the air gap is constantly reduced until the piston (5) reaches top dead center. Depending on the embodiment of the present invention, a higher voltage will jump the gap from the center electrode (19) of the spark plug (15) to the piston (5) face or head head screw (8) sooner than a lower voltage. This offers the option to immensely simplify the ignition system of the invention (assuming the invention is to be equipped with an ignition system at all, which is not necessary as an ignition system merely increases the starting reliability of the engine in extreme environments, examples of such environments include but are not limited to arctic environment and space applications). Furthermore, there is an increase in overall efficiency because a protruding electrode (19) or hot bulb (16) of a spark plug (15) or glow plug (17), respectively, will offer a higher compression ratio than conventional spark plug (15) or glow plug (17) installation methods.

Though a piston (5) without a bushing (6) can work, to augment or replace lubrication a section of the piston (5), preferably the center of the piston (5) can be reduced in diameter to receive a bushing (6) with a lower coefficient of friction to prevent piston seizure, reduce wear, provide a permanent or semi-permanent source of lubrication, and conduct thermal energy from the piston into the walls of the cylinder. Such bushing can be made of bronze, low friction alloys, they can be coated with various surface treatments to reduce friction and wear, and graphite can be used in addition to or instead of alloy bushings (6). If using a graphite bushing (6), any graphite that ablates from the surface of the bushing contacting the cylinder wall due to friction, heat, or thermal expansion of the piston will be contained by the top rings (18). Any graphite that gets squeezed between the cylinder and piston ring (18) will be embedded into the surface and pores of the cylinder wall. In this way the piston (5) can be said to be permanently lubricated for life of the piston (5) and/or cylinder.

Though FIG. 1 illustrates two series of intake ports (3) per cylinder, if the piston is constructed to be shorter than is illustrated on FIG. 1 only one series of Intake Ports (3) would be necessary to serve both the outer combustion chamber (10) and inner combustion chamber (11). The same is also true of the Exhaust Ports (4) if the piston is of the flat top (21) variety or if the piston is of the conventional deflector (20) type variety rather than the QUB (19) type deflector pistons as illustrated in FIG. 1.

An alternative embodiment of the present invention involves integrating valves in the tops of the outer combustion chambers (10) and uses holes drilled around the periphery of the cylinders as exhaust ports. In such an embodiment the outer combustion chambers (10) of the present invention would operate with a uniflow scavenging type of exhaust and intake flow for increased volumetric efficiency.

Alternative embodiment's of the quadruple acting scotch yoke engine include using the inner combustion chambers (11) not as combustion chambers but rather expansion chambers for steam or expanding gases. In such an embodiment a water or fluid jacket would be integrated into the engine. But rather than wasting this energy via a radiator, the water jacket would operate at temperatures and pressures high enough to build effective pressure. Holes could be drilled in the piston and cylinder in such a manner that it would feed dry steam or pressurized fluid into the inner chamber (11) when the piston reaches the point in its stroke where it is closest to the block/crankcase (14). In this embodiment the piston (5) would be its own slide valve to control steam delivery. Alternatively, electronically controlled valves could be used to time fluid injection into the inner chambers (11). In such embodiment's the present invention would be an external/internal combustion gas/steam hybrid. Such am embodiment may operate at a higher thermal efficiency than the previously described embodiment's because of its exploitation of adiabatic principles of heat reclamation, but would have an overall lower power to weight ratio. Additionally, in the present invention it is particularly easy to integrate a compressed air starting system. Pressurized air can be delivered via controlled timing valves to the combustion chambers (11 and/or 10) to start the quadruple acting scotch yoke engine. This is useful for applications where the present invention is installed on vehicles that have integrated air compressors such as commercial vehicles like tractors, mining and construction equipment, aircraft, trucks, ships, and the like. Such an embodiment renders a separate starter redundant and as a result can reduce the overall weight of the vehicle the present invention is installed into if a separate starter is foregone. If a separate starter is not foregone such an embodiment offers two methods to start the engine for increased starting reliability, or if necessary for specialized applications both methods can be used simultaneously for increased torque/power to start the engine.

Though any style of crankshaft may be used, due to the proportionately greater forces for a given size, which can be especially high when the engine is operating in a pulse detonation cycle mode of operation, the present invention functions with higher degree's of reliability and longevity when the scotch yoke (1) is coupled to a tunnel crankshaft (22) such as a disc webbed style tunnel crank that rides on roller bearings (23) and/or triple slipper bearings. Such a tunnel crankshaft (22) is ideally to be manufactured using multiple pieces that are bolted or otherwise affixed together. This facilitate easy assembly and disassembly of the engine components that reside in the block/crankcase (14), such the yoke (1), connecting rods (12), and the bearings (13) that the yoke journal (2) rides on. Manufacturing the tunnel crankshaft (22) in such a manner also allows the present invention to use solid one piece bearings (13) on the yoke journal rather than the split bearings used in previous scotch yoke and most conventional engine designs. Using one piece bearings (13) reduces manufacturing costs and increases reliability and longevity and is easier to replace and maintain, remove, and install than split bearings such as the oil pressurized babbitt bearings used in most conventional internal combustion engines.

To further increase the compression ratio when embodied with cross flow exhaust and intake ports (3 and 4) and deflector (20) pistons (5), the top and/or bottom of the combustion chambers (10 and 11) can be made with a negative impression profile that matches and mirrors the profile of the tops of the pistons.

I claim:

1. A quadruple acting scotch yolk engine comprising:

a crankshaft, said crankshaft disposed in communication with a yolk journal;

two double-acting pistons, a yolk, and a connecting rod connected together forming an assembly, said two-double acting pistons screwed to said connecting rod;

a cylinder, said cylinder housing said piston;

wherein said two double-acting pistons are connected to said connecting rod via a wrist pin;

an inner combustion chamber, said inner combustion chamber disposed in communication with said cylinder, adjacent to each piston of said two double-acting pistons;

an outer combustion chamber, said outer combustion chamber disposed in communication with said cylinder, opposite of said inner combustion chamber, adjacent to each piston of said two double-acting pistons;

threaded holes, said threaded holes disposed in communication with said outer combustion chamber of said cylinder;

wherein said two double-acting pistons are double sided, facilitating compression on both an upstroke and a downstroke of each of said two double-acting pistons; and graphite coated bushings, said graphite coated bushings disposed in communication with each of said two double-acting pistons, lubricating said two double-acting pistons.

2. The apparatus of claim 1, wherein said crankshaft is a roller disc webbed tunnel type crankshaft.

3. The apparatus of claim 2, wherein said yolk is connected to said webbed tunnel type crankshaft.

4. The apparatus of claim 3, wherein said connecting rod is cylindrical.

5. The apparatus of claim 1, wherein said two double-acting pistons are cylindrical slugs.

6. The apparatus of claim 1, wherein said threaded holes are configured to receive at least one of the following: at least one spark plug, and at least one glow plug.

7. The apparatus of claim 2, wherein said threaded holes are configured to receive at least one of the following: at least one spark plug, and at least one glow plug.

8. The apparatus of claim 4, wherein said threaded holes are configured to receive at least one of the following: at least one spark plug, and at least one glow plug.

9. The apparatus of claim 1, further comprising:

only one series of intake ports, said only one series of intake ports connected to said cylinder and said inner and outer combustion chamber;

only one series of exhaust ports, said only one series of exhaust ports connected to said cylinder and said inner and outer combustion chamber; and one-piece bearings that are solid not split, said one-piece bearings are disposed in connection to the yoke via said yoke journal.

10. The apparatus of claim 1, wherein said two double-acting pistons are skirtless pistons.

11. The apparatus of claim 8, further comprising:

intake ports, said intake ports connected to said cylinder;

exhaust ports, said exhaust ports connected to said cylinder; and one-piece bearings, said one-piece bearings are disposed in connection to the yoke via said yoke journal.

12. The apparatus of claim 11, wherein each iteration of said assembly has two pistons.

* * * * *